US008461945B2

(12) United States Patent
Ligander et al.

(10) Patent No.: US 8,461,945 B2
(45) Date of Patent: Jun. 11, 2013

(54) FIRST AND SECOND U-SHAPE WAVEGUIDES JOINED TO A METALLIZED DIELECTRIC CARRIER BY A U-SHAPE SEALING FRAME

(75) Inventors: Per Ligander, Göteborg (SE); Marcus Karl Hasselblad, Mölndal (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 337 days.

(21) Appl. No.: 12/810,053

(22) PCT Filed: Mar. 27, 2008

(86) PCT No.: PCT/SE2008/000231
§ 371 (c)(1),
(2), (4) Date: Jun. 22, 2010

(87) PCT Pub. No.: WO2009/082314
PCT Pub. Date: Jul. 2, 2009

(65) Prior Publication Data

US 2010/0289602 A1 Nov. 18, 2010

(30) Foreign Application Priority Data

Dec. 20, 2007 (SE) ..... 0701152

(51) Int. Cl.
*H01P 1/04* (2006.01)
*H01P 1/208* (2006.01)

(52) U.S. Cl.
USPC ..... 333/254; 333/212

(58) Field of Classification Search
USPC ..... 333/248, 254, 239, 208, 212, 24 R, 333/26, 27, 137, 157
See application file for complete search history.

(56) References Cited

U.S. PATENT DOCUMENTS

| | | | | |
|---|---|---|---|---|
| 4,517,536 | A * | 5/1985 | Stern et al. | 333/254 |
| 6,768,401 | B2 * | 7/2004 | Koriyama | 333/248 |
| 7,323,954 | B2 * | 1/2008 | Lee et al. | 333/202 |
| 2004/0183627 | A1 * | 9/2004 | Lo Hine Tong et al. | 333/212 |

FOREIGN PATENT DOCUMENTS

| | | | |
|---|---|---|---|
| FR | 2 660 803 | A1 | 10/1991 |
| JP | 63013501 | A | 1/1988 |
| JP | 2005 130406 | A | 5/2005 |

OTHER PUBLICATIONS

Mueller, T. et al, SMD-Type 42 GHz Waveguide Filter. 2003 IEEE MTT-S International Microwave Symposium Digest. Philadelphia, Pa Jun. 6-13, 2003.

Mueller, T. et al, Surface-Mountable Metalized Plastic Waveguide Filter Suitable for High Volume Production. 33rd European Microwave Conference, Munich 2003.

* cited by examiner

*Primary Examiner* — Benny Lee
(74) *Attorney, Agent, or Firm* — Roger S. Burleigh

(57) ABSTRACT

The present invention relates to a transition arrangement comprising a first surface-mountable waveguide part, a second surface-mountable waveguide part and a dielectric carrier material with a metalization provided on a first main side. Each of the first and second surface-mountable waveguide parts comprises a first wall, a second wall and a third wall, which second and third walls are arranged to contact a part of the metalization, where the first and second surface-mountable waveguide parts are arranged to be mounted on the dielectric carrier material in such a way that the first and second surface-mountable waveguide parts comprise ends which are positioned to face each other. The transition arrangement further comprises an electrically conducting sealing frame that is arranged to be mounted over and covering the ends, where the electrically conducting sealing frame has a first wall, a second wall and a third wall, where the second and third walls are arranged to contact a part of the metallization.

15 Claims, 6 Drawing Sheets

Section A-A

FIRST AND SECOND U-SHAPE WAVEGUIDES JOINED TO A METALLIZED DIELECTRIC CARRIER BY A U-SHAPE SEALING FRAME

TECHNICAL FIELD

The present invention relates to a transition arrangement comprising a first surface-mountable waveguide part, a second surface-mountable waveguide part and a dielectric carrier material with a metalization provided on a first main side, the first surface-mountable waveguide part comprising a first wall, a second wall and a third wall, which second and third walls are arranged to contact a part of the metalization, all the walls together essentially forming a U-shape, the second surface-mountable waveguide part comprising a first wall, a second wall and a third wall, which second and third walls are arranged to contact a part of the metalization, all the walls together essentially forming a U-shape, where the first and second surface-mountable waveguide parts are arranged to be mounted on the parts of the metalization in such a way that the first and second surface-mountable waveguide parts comprise ends which are positioned to face each other.

BACKGROUND

When designing microwave circuits, transmission lines and waveguides are commonly used. A transmission line is normally formed on a dielectric carrier material. Due to losses in the dielectric carrier material, it is sometimes not possible to use any transmission lines. When there for example is a diplexer in the layout, the diplexer may have to be realized in waveguide technology. Waveguides are normally filled with air or other low-loss materials.

Waveguide diplexers used today are large mechanical components screwed into a mechanical cabinet and connected to different parts such as for example an antenna via some type of waveguide flange. It is desirable to mount such a diplexer structure on a dielectric carrier material, such that the diplexer structure forms a surface-mounted waveguide structure.

Such a surface-mounted waveguide is normally made having three walls and one open side. Metalization is then provided on the side of the dielectric carrier material facing the waveguide, where the metalization serves as the remaining wall of the waveguide, thus closing the waveguide structure when the waveguide is fitted to the dielectric carrier material.

An example of surface-mountable waveguides is disclosed in the paper "Surface-mountable metalized plastic waveguide filter suitable for high volume production" by Thomas J Müller, Wilfried Grabherr, and Bernd Adelseck, 33$^{rd}$ European Microwave Conference, Munich 2003. Here, a surface-mountable waveguide is arranged to be mounted on a so-called footprint on a circuit board. A microstrip conductor to waveguide transition is disclosed, where the end of the microstrip conductor acts as a probe for feeding the waveguide's opening.

But in order to achieve surface mounting, larger mechanical components such as a triplexer may result in problems with mechanical stress problems due to different coefficients of thermal expansion ("CTE") of the materials involved. Furthermore, such a large surface-mounted structure as a triplexer is too large to handle in an automated production line.

One way to solve this problem is to split up the diplexer into a number of smaller parts. These parts have to be sufficiently connected to each other in order to present a proper electrical function. This problem is apparent for all large surface-mounted waveguide structures.

An example of a solution according to prior art is disclosed in prior art FIG. 1, showing a simplified cross-sectional side-view. A first surface-mounted waveguide part P1 and a second surface-mounted waveguide part P2 are mounted on a dielectric carrier material P3. The ends of the first and second surface-mounted waveguide parts P1, P2 that face each other comprise respective 90° bends P4, P5, changing the direction of the transmitted signals 90° such that the signals are directed through corresponding openings P6, P7 in the dielectric carrier material P3. On the other side of the dielectric carrier material P3, a third surface-mounted waveguide part P8 is mounted, the third surface-mounted waveguide part P8 comprising two 90° bends P9, P10 positioned such that the signal directed through the openings P6, P7 is guided through the third surface-mounted waveguide part P8 in such a way that the third surface-mounted waveguide part P8 functions as a link between the first surface-mounted waveguide part P1 and the second surface-mounted waveguide part P2. The details of the bends P4, P5, P9, P10 are not shown in FIG. 1, only the function is schematically indicated.

This solution is, however, quite complicated and requires that a special waveguide part, having two 90° bends, is mounted on the other side of the dielectric carrier material, and that all waveguide parts are aligned with the openings such that there is no interruption in the transmission of the signals.

SUMMARY OF THE INVENTION

The object of the present invention is to provide a waveguide transition arrangement between different surface-mounted waveguide structure parts which are to be sufficiently electrically connected to each other in order to present a proper electrical function.

This problem is solved by means of a waveguide arrangement as mentioned initially. The arrangement further comprises an electrically conducting sealing frame (also referred to as a "sealing frame") that is arranged to be mounted over and covering the ends, where the sealing frame has a first wall, a second wall and a third wall, where the second and third walls are arranged to contact a part of the metalization, all the walls together essentially forming a U-shape.

According to a preferred embodiment, there is a junction slot between the ends, where the sealing frame is arranged to seal the junction slot, such that the transition properties for a signal that is transferred between the surface-mounted waveguide parts (also referred to as "waveguide parts") are enhanced. In other words, the properties of the signal are enhanced as the signal transitions between the surface-mounted waveguide parts due to the sealing frame.

According to another preferred embodiment, the waveguide parts each have a respective longitudinally extending flange part comprised in each of the second walls and third walls, and that the sealing frame has a respective longitudinally extending flange part, each having a length, the flange parts being comprised in each of the second wall and third wall, all the flange parts being arranged to be the parts of the walls which contact the corresponding parts of the metalization when the waveguide parts and the sealing frame are mounted.

According to another preferred embodiment, the flange parts of the waveguide parts do not extend to the ends of the waveguide parts, such that a first distance between the ends of opposing flange parts of the second walls of the waveguide parts and a second distance between the ends of opposing flange parts of the third walls of the waveguide parts both exceed the length of each one of the flange parts of the sealing frame, such that the flange parts of the sealing frame may be fitted between the respective flange parts of the waveguide parts.

According to another preferred embodiment, the sealing frame is made in several layers of material including an outer layer being made of a polymer, a middle layer constituting a metalization layer, thereby making the sealing frame electrically conductive, and an inner layer comprising an electrically conducting attachment means in the form of a soft solder alloy or electrically conducting glue.

According to another preferred embodiment, in a part of the first surface-mountable waveguide part (also referred to as the "first waveguide part") which is arranged to be covered by the sealing frame, a first recess is formed, running perpendicular to the longitudinal extension of the first waveguide part, all the way along the three walls, where a corresponding second recess is formed on the second surface-mountable waveguide part (also referred to as the "second wavequide part"), and where, corresponding to the recesses, lines of an electrically conducting attachment means are dispensed on the sides of the walls of the sealing frame that are intended to face the first and second waveguide parts, such that the lines of electrically conducting attachment means are fitted into the recesses when the sealing frame is mounted.

According to another preferred embodiment, the first surface-mountable waveguide part, the second surface-mountable waveguide part and the sealing frame comprise at least one waveguide filter iris and at least one waveguide filter protruding part arranged for matching of a filter cavity, such that these parts constitute a waveguide filter when mounted together.

According to another preferred embodiment, the sealing frame comprises at least one protruding part on the side of a first wall, facing the dielectric carrier material when the sealing frame is mounted, and each surface-mountable waveguide part comprises at least one iris, such that a cavity structure is formed and the sealing frame at least partly forms the walls and roof of the cavity structure when the surface-mountable waveguide parts and the sealing frame are mounted.

According to another preferred embodiment, at least one sealing frame and at least two waveguide parts are combined such that a filter comprising at least two cavity structures is formed, the filter thus having at least two poles.

Other preferred embodiments are evident from the disclosure as set forth below.

A number of advantages are provided by the present invention. For example:

- the sealing arrangement is simple and of low cost;
- a connection of two surface-mounted waveguide parts is achieved without disturbance of the waveguide mode of a propagating signal;
- two surface-mounted waveguide parts are connected in a loss-less manner;
- two surface-mounted waveguide parts are connected in a flexible manner, providing a relaxed relation between the waveguide parts due to the ductile behavior of the sealing frame;
- two surface-mounted waveguide parts are connected without any risk of leakage;
- the present invention can be assembled using a pick-and-place machine; and
- two surface-mounted waveguide parts are connected using no extra area on the dielectric carrier material on which the surface-mounted wavequide parts are mounted.

BRIEF DESCRIPTION OF THE DRAWINGS

The present invention will now be described more in detail with reference to the appended drawings, where.

DETAILED DESCRIPTION OF THE INVENTION

Figure 1:
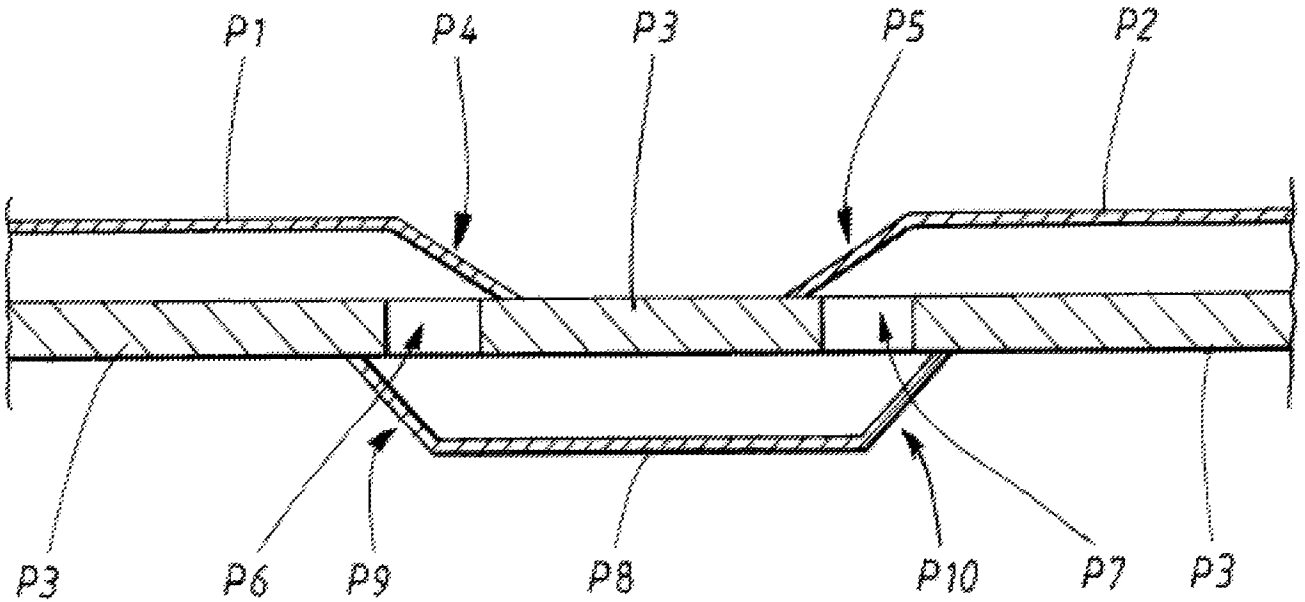
FIG. 1 PRIOR ART
FIG. 1 is a sectional side-view of a prior art configuration.
Figure 2A:
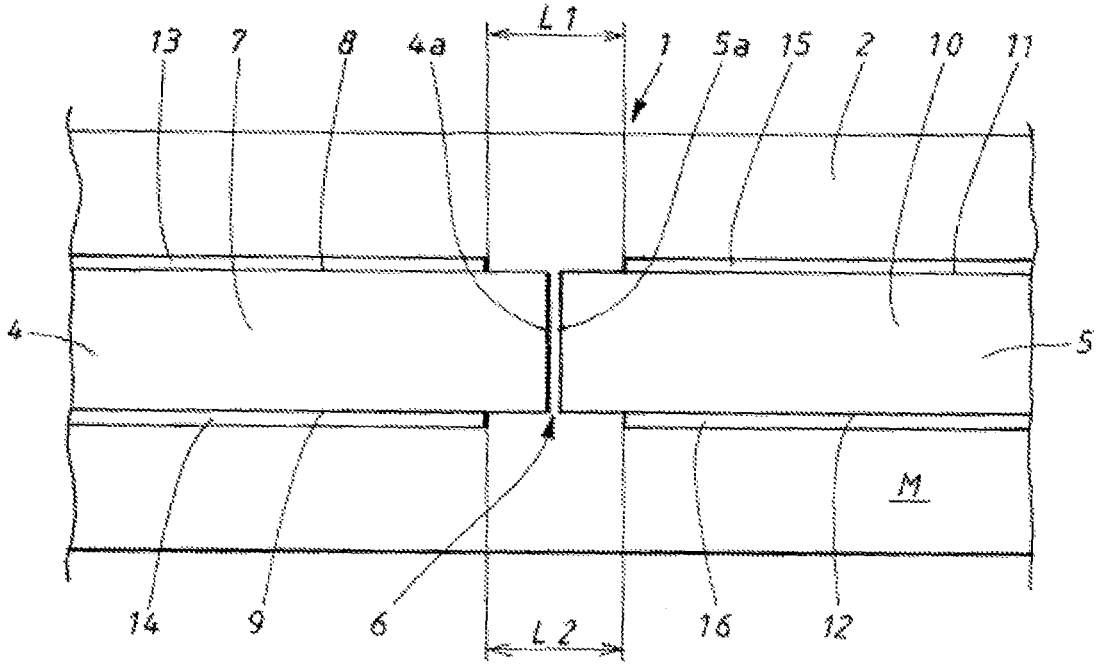
FIG. 2*a* is a top view of two surface-mounted waveguide parts.
Figure 2B:
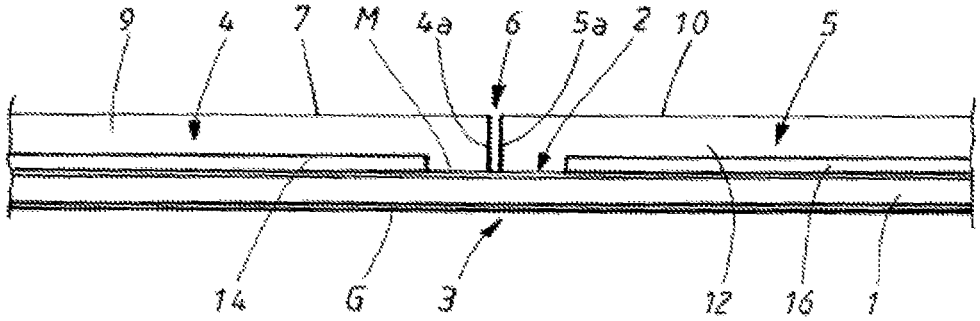
FIG. 2*b* is a side view of two surface-mounted waveguide parts.

In FIG. 2*a* and FIG. 2*b*, showing a respective top view and side view of a first embodiment example of the present invention, a dielectric carrier material 1 is shown, having a first main side 2 and a second main side 3 (see FIG. 2*b*), originally having a metallic copper cladding on both sides. The copper cladding on the second main side 3 is used as a ground plane G (see FIG. 2*b*), and the copper cladding on the first main side 2 is generally etched away to such an extent that desired copper patterns are formed on the first main side 2, constituting a metalization M. A first surface-mountable waveguide part (also referred to as a "first wavequide part") 4 and a second surface-mountable waveguide part (also referred to as a "second wavequide part") 5 are mounted on a part of the metalization M that is provided on the first main side 2. The respective ends 4*a*, 5*a* of the first and second surface-mounted waveguide parts 4, 5 that face each other are positioned relatively close to each other, preferably as close as possible, minimizing a junction slot 6 between the first and second waveguide parts 4, 5.

With continuing reference to FIGS. 2*a* and 2*b*, each of the first and second waveguide parts 4, 5 is made in an electrically conducting material and has three walls 7, 8 (see FIG. 2*a*), 9 for the first waveguide part 4 and three walls 10, 11 (see FIG. 2*a*), 12 for the second waveguide part 5 and one open side, arranged to face the dielectric carrier material 1 (see FIGS. 2*a* and 2*b*). A part of the metalization M provided on the first main side 2 of the dielectric carrier material 1, serves as the remaining wall of the first and second waveguide parts 4, 5, thus dosing the first and second waveguide part 4, 5 when mounted.

Figure 2C:
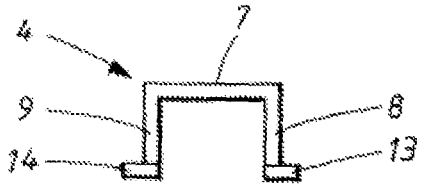
FIG. 2*c* is an end view of a surface-mountable waveguide part.

Regarding the first waveguide part 4, with reference to FIGS. 2*a*, 2*b* and 2*c*, a first wall 7 is arranged to be parallel to the dielectric carrier material 1 when the first waveguide part 4 is mounted, and then held at a distance from the dielectric carrier material 1 by means of a second wall 8 and third wall 9, where the second and third walls 8, 9 are arranged to contact a part of the metalization M on the first main side 2 of the dielectric carrier material 1 (see FIG. 2*a*), all the walls 7, 8, 9 together essentially forming a U-shape when regarding the first waveguide part 4 from a short end thereof. The second waveguide part 5 has the same configuration of the walls 10, 11, 12.

The first and second waveguide parts 4, 5 are mounted in a known way, each having a longitudinally extending flange part (also referred to as a "flange") 13 (see FIG. 2*a* and 2*c*), 14, 15 (see FIG. 2*a*), 16 comprised in each of the second walls 8, 11 and third walls 9, 12, the flanges 13, 14, 15, 16 being arranged to be the parts of the walls 8, 11, 9, 12 which contact a part of the metalization M on the first main side 2 of the dielectric carrier material 1 when the first and second waveguide parts 4, 5 are mounted. The flanges 13, 14, 15, 16 are soldered, or glued by means of electrically conducting glue, to the parts of the metalization M on the first main side 2 of the dielectric carrier material 1 which generally is constituted by a corresponding so-called footprint of copper, which footprint thus is comprised in the metalization M on the first main side 2 of the dielectric carrier material 1. In this particular application, there may not be any need for a particular footprint, but some kind of guidance for the mounting of the first and second surface-mountable waveguide parts 4, 5 is preferred.

As indicated above, there is, however, always a junction slot 6 between the first and second waveguide parts 4, 5 when mounted. At the junction slot 6, the currents running between the first and second waveguide parts 4, 5 experience a discontinuity, and there is possibly also undesired leakage at the junction slot 6. It should be noted that like features with the same reference numbers in different Figures often will not be described again in the interest of brevity.

Figure 3A:
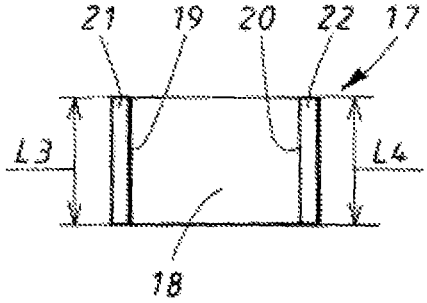
FIG. 3*a* is a top view of a sealing frame according to the present invention.
Figure 3B:
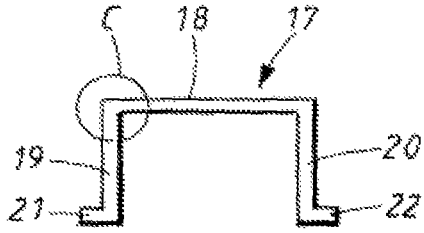
FIG. 3*b* is an end view of a sealing frame according to the present invention.
Figure 4A:
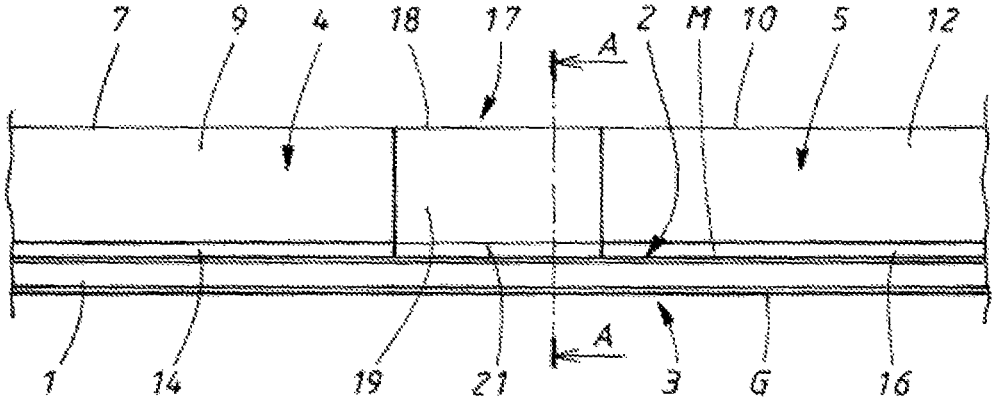
FIG. 4*a* is a side view of a sealing frame according to the present invention being mounted to two surface-mounted waveguide parts.

According to the present invention, with reference to FIG. 3*a*, FIG. 3*b* and FIG. 4*a*, an electrically conducting sealing frame (also referred to as a "sealing frame") 17 is arranged to be mounted over the junction slot 6 (see also FIGS. 2*a* and 2*b*). The sealing frame 17 has a first wall 18, a second wall 19 and a third wall 20 (see FIGS. 3*a* and 3*b*), where the first wall 18 is arranged to be parallel to the dielectric carrier material 1 when mounted, and then held at a distance from the dielectric carrier material 1 by means of the second wall 19 and the third wall 20, which second and third walls 19, 20 are arranged to contact a part of the metalization M on the first main side 2 of the dielectric carrier material 1, all the walls 18, 19, 20 together essentially forming a U-shape when regarding the sealing frame 17 from a short end thereof.

With continuing reference to FIGS. 3*a* and 3*b*, the sealing frame 17 has a respective longitudinally extending flange part (also referred to as a "flange(s)") 21, 22 comprised in each of the second wall 19 and third wall 20, each having a length L3, L4 (see FIG. 3*a*), the flanges 21, 22 being arranged to be the parts of the walls 19, 20 which contact the a part of the metalization M on the first main side 2 of the dielectric carrier material 1 when the sealing frame 17 is mounted. The lengths L3, L4 of the flanges 21, 22 are preferably essentially equal.

The sealing frame 17 has such dimensions to fit the sealing frame 17 over the first and second waveguide parts, i.e. the inner dimensions of the sealing frame 17 are equal to, or greater than, the outer dimensions of the first and second waveguide parts 4, 5. The thickness of the sealing frame 17 is not of importance. However, the sealing frame 17 should preferably be rigid enough to be handled, for example by a human or by a pick-and place machine.

As can be seen in FIG. 2*a* and FIG. 2*b*, the flanges 13, 14, 15, 16 of the first and second waveguide parts 4, 5 do not extend to the ends 4*a*, 5*a* of the first and second waveguide parts 4, 5 that face each other, such that a first distance L1 (see FIG. 2*a*) between the ends of opposing flanges 13, 15 of the second walls 8, 11 of the first and second waveguide parts 4, 5 and a second distance L2 (see FIG. 2*a*) between the ends of opposing flanges 14, 16 of the third walls 9, 12 of the first and second waveguide parts 4, 5 both exceed the lengths L3, L4 (see FIG. 3*a*) of each one of the flanges 21, 22 of the sealing frame 17, such that the flanges 21, 22 of the sealing frame 17 (see FIG. 3*b*) may be fitted between the respective flanges 14, 16, 13, 15 of the first and second waveguide parts 4, 5. Preferably, the distances L1 and L2 between the ends of opposing flanges 14, 16, 13, 15 of the first and second waveguide parts 4, 5 are positioned essentially opposite each other with reference to the longitudinal extension of the first and second waveguide parts 4, 5.

Figure 4B:
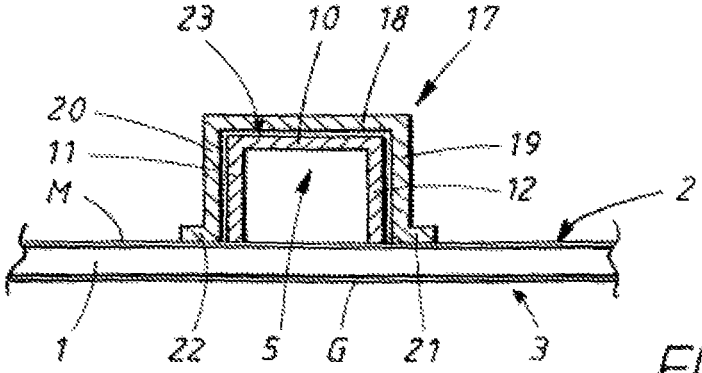
FIG. 4*b* is a sectional view of a section A-A in FIG. 4*a;*

With reference to FIG. 4*a* and FIG. 4*b*, when mounted, the sealing frame 17 is fitted over the junction slot 6 (see FIGS. 2*a* and 2*b*) between the first and second waveguide parts 4, 5, sealing the same. The sealing frame 17 is then soldered to the first and second waveguide parts 4 (see FIG. 4*a*), 5. It is also conceivable that electrically conducting glue is used. The solder or glue is indicated with the reference number 23 (see FIG. 4*b*). The sealing frame 17 is also preferably soldered or glued to the part of the metalization M on the first main side 2 of the dielectric carrier material 1 that is in contact with the flanges 21, 22 (see FIG. 4*b*) of the sealing frame 17.

Figure 5:
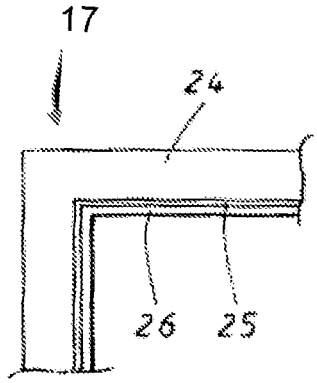
FIG. 5 is a detailed view of a part of the sealing frame, illustrating a preferred embodiment.

According to a preferred embodiment, with reference to FIG. 5, showing the part of the sealing frame 17 indicated by a circle C in FIG. 3*b*, the sealing frame 17 is made in several layers of material. For rigidity, the outer layer 24 is made of a ductile layer, for example a polymer. Inside the outer layer 24 there is a metalization layer 25, making the sealing frame 17 electrically conductive. The metalization layer 25 is in turn covered by a soft solder alloy 26 with an appropriate thickness, for example about 150 micrometers ("μm"). The soft solder alloy 26 may be exchanged with any appropriate electrically conducting attachment means, such as electrically conducting glue.

Figure 6:
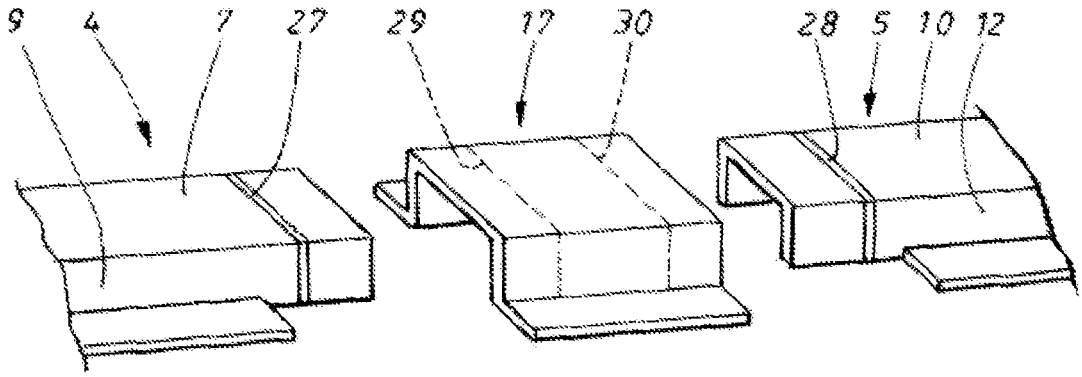
FIG. 6 is a perspective view of two surface-mountable waveguide parts and a sealing frame according to the present invention, positioned slightly apart from each other.

According to another preferred embodiment, with reference to FIG. 6, showing a perspective view of the first waveguide part 4, the second waveguide part 5 and the sealing frame 17 positioned slightly apart from each other, at the part of the first waveguide part 4 which is arranged to be covered by the sealing frame 17, a first recess 27 is formed. The first recess 27 runs perpendicular to the longitudinal extension of the first waveguide part 4, all the way along the three walls 7, 8 (see FIG. 2*a*), 9. A corresponding second recess 28 is formed on the second waveguide part 5.

Corresponding to the recesses 27, 28, lines of solder compound 29, 30 are dispensed on the sides of the walls 18, 19, 20 of the sealing frame 17 (see also FIGS. 3*a* and 3*b*) that are intended to face the first and second waveguide parts 4, 5, such that the lines of solder 29, 30 are fitted into the recesses 27, 28 when the sealing frame 17 is mounted. It is possible to combine the lines of solder 29, 30 with indents in the sealing frame 17, the indents being intended to fit into the recesses 27, 28 when the sealing frame 17 is mounted. The solder may be exchanged with any appropriate electrically conducting attachment means, such as electrically conducting glue.

According to a special embodiment of the present invention, a sealing frame may be used in a surface-mounted waveguide filter.

Surface-mounted waveguide filters are for example used in a diplexer structure, where the diplexer structure needs to support different frequency channels within a certain frequency band. In order to obtain these different frequency channels, each filter in the diplexer structure has to be calibrated by means of screws which are screwed into a filter wall. The screws form matching elements when the screws protrude from the filter wall, entering cavity structures of the filter in a previously known way. By setting each screw at a certain protrusion, a calibrated filter is obtained, but finding the optimal level of protrusion is a time-consuming task.

Furthermore, as mentioned initially, it is necessary to split up the diplexer into a number of smaller parts.

Figure 7A:
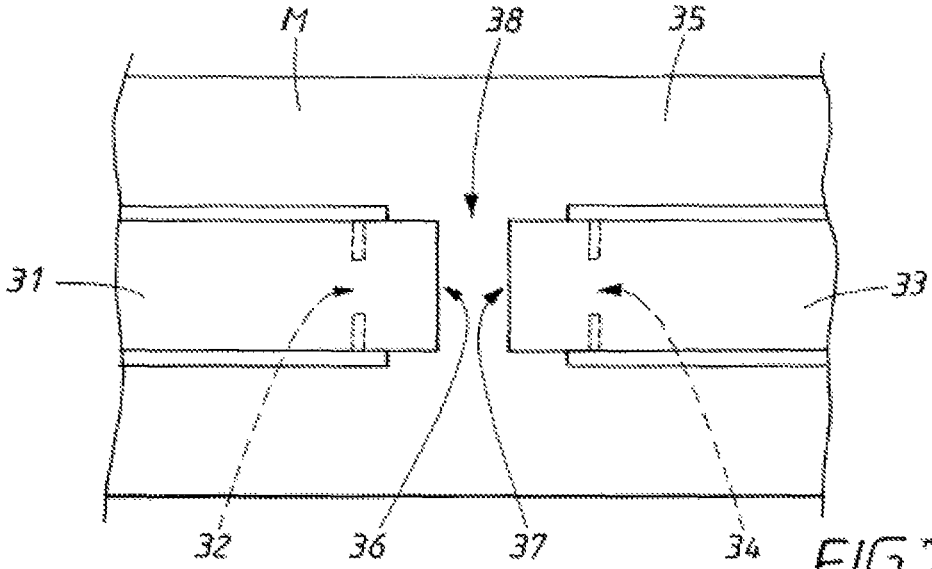
FIG. 7*a* is a top view of two surface-mounted waveguide filter parts.

FIG. 7*a* shows a first surface-mountable waveguide part (also referred to as a "first wavequide part") 31 comprising a first filter iris 32, and a second surface-mountable waveguide part (also referred to as a "second wavequide part") 33 comprising a second filter iris 34. The first and second surface-mountable waveguide parts 31, 33 are mounted in the same manner as the previously described waveguide part, such that one opening 36 of the first waveguide part 31 faces an opening 37 of the second waveguide part 33.

Figure 7B:
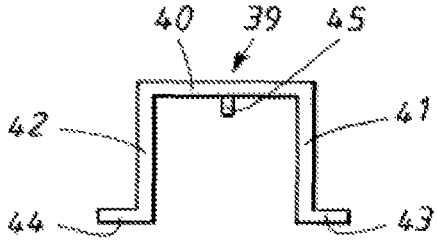
FIG. 7*b* is an end view of a sealing frame arranged for a filter application.

There is a certain gap 38 between the first and second waveguide parts 31, 33 and, with reference to FIGS. 7*a* and 7*b*, an electrically conducting sealing frame (also referred to as a "sealing frame") 39 (see FIG. 7*b*) is arranged to be mounted over the gap 38 (see FIG. 7*a*). The sealing frame 39 as shown in FIG. 7*b* is similar in appearance to the one described previously, having a first wall 40, a second wall 41 and a third wall 42, where the first wall 40 is arranged to be parallel to the dielectric carrier material 35 (see FIG. 7*a*) when the sealing frame 39 is mounted, and then held at a distance from the dielectric carrier material 35 by means of the second wall 41 and the third wall 42, all the walls 40, 41, 42 together essentially forming a U-shape when regarding the sealing frame 39 from a short end thereof.

The sealing frame 39 has respective longitudinally extending flange parts (also referred to as a "flange(s)") 43, 44 comprised in each of the second wall 41 and third wall 42 as shown in FIG. 7*b*.

Figure 7C:
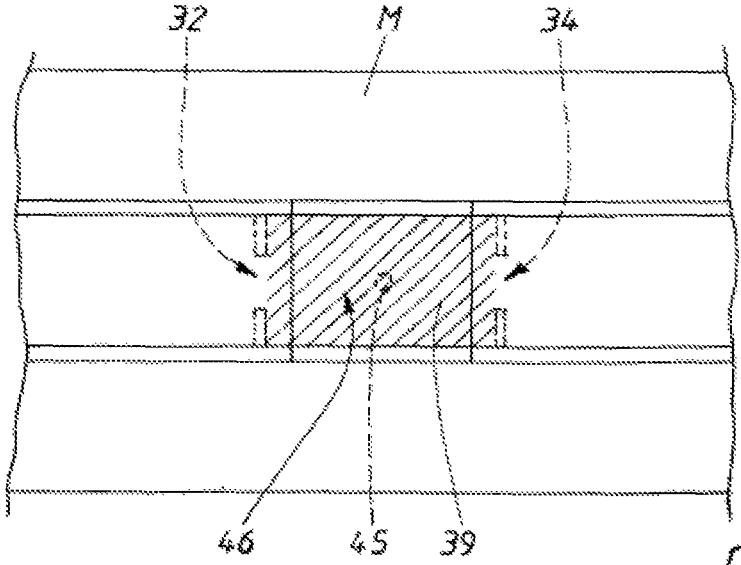
FIG. 7*c* is a top view of the sealing frame according to FIG. 7*b* being mounted to the surface-mounted waveguide parts according to FIG. 7*a;*

An important difference is that the sealing frame 39 comprises a protruding part 45 (see FIG. 7*b*) on the side of the first wall 40 that faces the dielectric carrier material 35 when the sealing frame 39 is mounted, being arranged to match the filter that is obtained, as shown in FIG. 7*c*. Between the pair of irises 32, 34, a cavity structure 46 is formed, indicated with diagonal lines in FIG. 7*c*, and the sealing frame 39 at least partly forms the walls and roof of the cavity structure 46. The protruding part 45 has the same task as the previously described screw to match the properties of a cavity structure. The protruding part 45 has a specific size and is made of a certain material. The protruding part 45 can be made to confer the proper conditions for the cavity structure 46 to meet the desired channel frequency. It is of course necessary that the gap 38 is wide enough to permit the protruding part 45 to enter into the cavity structure 46.

Figure 8:
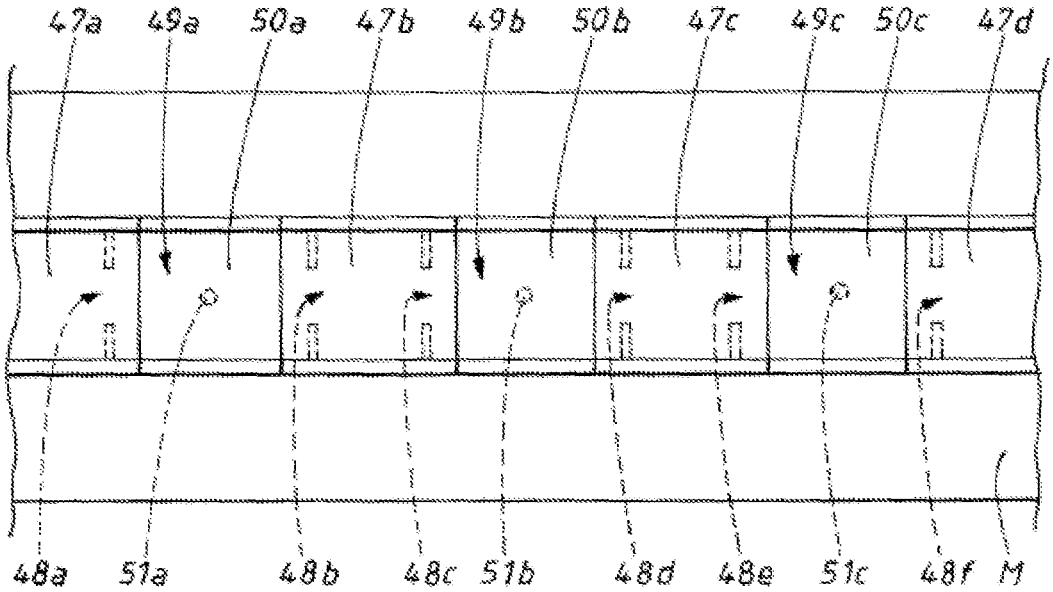
FIG. 8 is a top view of a multiple filter arrangement according to the arrangement in FIG. 7*c*.

With reference to FIG. 8, it is of course possible to mount a number of surface-mountable waveguide parts (also referred to as "waveguide parts") 47*a*, 47*b*, 47*c*, 47*d*, comprising irises 48*a*, 48*b*, 48*c*, 48*d*, 48*e*, 48*f*, after each other, such that a number of cavity structures 49*a*, 49*b*, 49*c* are formed when corresponding sealing frames 50*a*, 50*b*, 50*c* with protruding parts 51*a*, 51*b*, 51*c* are mounted. For each cavity structure, a pole is added to the filter. Each waveguide part comprises at least one iris.

In this way, a high degree of freedom and versatility is acquired, since it is now possible to choose the correct parts from a number of prefabricated parts and mount the parts in such a way that a desired filter and diplexer is obtained. In other words, a modular building block technique may be used, offering a large number of combinations. The length of each cavity structure may be adjusted to a desired value just by mounting the waveguide parts with a certain gap between each other. If the sealing frame has a sufficient length, the sealing frame will cover the gap, and the desired cavity structure may be obtained.

More than one protruding part may be used for each sealing frame, should it be desired. The protruding parts can have any appropriate form and be made in any appropriate material. If not necessary for a certain cavity, no protruding part is used.

Figure 9:
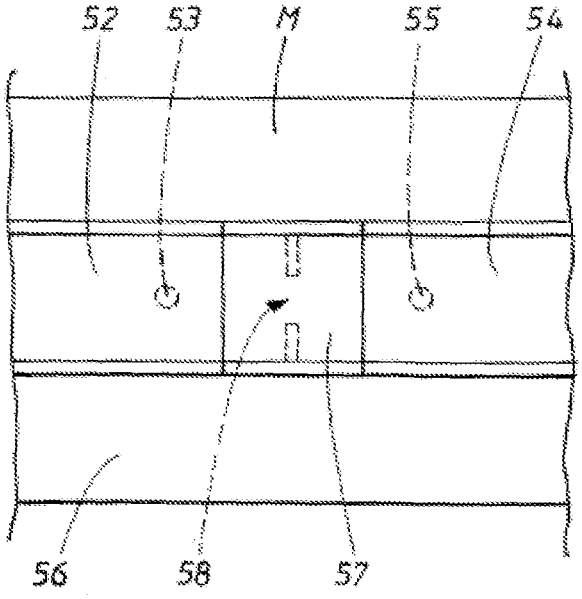
FIG. 9 is a top view of an alternative to the arrangement sealing frame according to the arrangement in FIG. 7*c.*

In an alternative embodiment form, with reference to FIG. 9, a first surface mountable waveguide part (also referred to as a "first wavequide part") 52 comprises a first protruding part 53, and a second surface-mountable waveguide part (also referred to as a "second wavequide part") 54 comprises a second protruding part 55. The first and second surface-mountable waveguide parts 52, 54 are mounted on a metalization Mon a dielectric carrier material 56 and joined by means of a sealing frame 57 in the same manner as described previously. The sealing frame 57 is here equipped with an iris 58. Generally, in this way, the first and second waveguide parts 52, 54 comprise protruding parts 53, 55, and the sealing frame 57 comprise the iris 58. This configuration is of course applicable to all filter embodiments discussed above. A combination is also conceivable.

The gap 38 discussed in the filter embodiments above, corresponds to the junction slot 6 described previously (see FIGS. 2*a*, 2*b* and 7*a*).

The shape and material of the protruding parts may be of any suitable form. The shape may for example be cylindrical or rectangular, and the material may for example be copper or a ferrite material.

The present invention is not limited to the embodiment examples according to the above, but may vary freely within the scope of the appended claims.

For example, the copper used on the first main side 2 and the second main side 3 (see FIGS. 2*a* and 2*b*) may be any suitable conducting material constituting a suitable metalization, for example silver or gold. The metal may be printed to the dielectric carrier material 1. There may also be several layers of metallic material, for example comprising solder.

The waveguide parts may also be made in a non-conducting material, such as plastic, which is covered by a thin layer of metalization.

The dielectric carrier material may comprise several layers if necessary, the layers comprising different types of circuitry. Such a layer structure may also be necessary for mechanical reasons.

The flanges may be of any suitable form, generally forming flange parts.

The invention claimed is:

1. A transition arrangement comprising:

a first waveguide part, a second waveguide part and a dielectric carrier material with a metalization provided on a first main side, the first waveguide part comprising a first wall, a second wall and a third wall, the second and third walls are arranged to contact a part of the metalization, the first, second and third walls together essentially forming a U-shape, the second waveguide part comprising a first wall, a second wall and a third wall, the second and third walls are arranged to contact a part of the metalization, the first, second and third walls together essentially forming a U-shape, the first and second waveguide parts are arranged to be mounted on the metalization in such a way that the first and second waveguide parts comprise respective ends that are positioned to face each other, and an electrically conducting sealing frame that is arranged to be mounted over and covering the respective ends where the electrically conducting sealing frame has a first wall, a second wall and a third wall, where the second and third walls are arranged to contact the metalization, the first wall of the electrically conducting sealing frame being substantially parallel to the dielectric carrier material and essentially forming a U-shape with the second and third walls of the electrically conducting sealing frame.

2. The transition arrangement according to claim 1, wherein a junction slot is disposed between the respective ends, where the electrically conducting sealing frame is arranged to seal the junction slot, such as to enhance a signal that is transferred between the first and second waveguide parts.

3. The transition arrangement according to claim 1, wherein the first and second waveguide parts each have a respective longitudinally extending flange part comprised in each of the second walls and third walls, and the electrically conducting sealing frame has a respective longitudinally extending flange part, each flange part being comprised in each of the second wall and the third wall, each flange part being arranged to be parts of the respective second and third walls that contact corresponding parts of the metalization when the first and second waveguide parts and the electrically conducting sealing frame are mounted.

4. The transition arrangement according to claim 3, wherein the flange parts of the first and second waveguide parts do not extend to the respective ends of the first and second waveguide parts, such that a first distance between the respective ends of opposing flange parts of the second walls of the first and second waveguide parts and a second distance between the respective ends of opposing flange parts of the third walls of the first and second waveguide parts both exceed a length of each one of the flange parts of the electrically conducting sealing frame, such that the flange parts of the electrically conducting sealing frame may be fitted between the respective flange parts of the first and second waveguide parts.

5. The transition arrangement according to claim 4, wherein the first distance and the second distance are essentially equal, and that the lengths of the flange parts of the electrically conducting sealing frame are essentially equal.

6. The transition arrangement according to claim 1, wherein the electrically conducting sealing frame is attached to the first and second waveguide parts by means of solder or electrically conducting glue.

7. The transition arrangement according to claim 1, wherein the electrically conducting sealing frame is made in several layers of material including an outer layer being made of a polymer, a middle layer constituting a metalization layer, thereby making the electrically conducting sealing frame electrically conductive, and an inner layer comprising an electrically conducting attachment means in a form of a soft solder alloy or electrically conducting glue.

8. The transition arrangement according to claim 1, wherein a part of the first waveguide part that is arranged to be covered by the electrically conducting sealing frame, a first recess is formed therein, running perpendicular to a longitudinal extension of the first waveguide part, along the first, second and third walls thereof, where a corresponding second recess is formed on the second waveguide part, and where, corresponding to the first and second recesses, lines of an electrically conducting attachment means are dispensed on sides of the first, second and third walls of the electrically conducting sealing frame that are intended to face the first and second waveguide parts, such that the lines of the electrically conducting attachment means are fitted into the first and second recesses when the electrically conducting sealing frame is mounted.

9. The transition arrangement according to claim 8, wherein the lines of the electrically conducting attachment means are combined with indents in the electrically conducting sealing frame, the indents being intended to fit into the first and second recesses when the electrically conducting sealing frame is mounted.

10. The transition arrangement according to claim 8, wherein the lines of the electrically conducting attachment means is in the form of solder or electrically conducting glue.

11. The transition arrangement according to claim 1, wherein the first waveguide part, the second waveguide part and the electrically conducting sealing frame comprise at least one waveguide filter iris and at least one waveguide filter protruding part to constitute a waveguide filter when mounted together.

12. The transition arrangement according to claim 11, wherein the electrically conducting sealing frame comprises the at least one waveguide filter protruding part on a side of the first wall thereof, facing the dielectric carrier material when the electrically conducting sealing frame is mounted, and in that each of the first and second waveguide parts comprises the at least one waveguide filter iris, such that a cavity structure is formed and the electrically conducting sealing frame at least partly forms walls and roof of the cavity structure when the first and second waveguide parts and the electrically conducting sealing frame are mounted.

13. The transition arrangement according to claim 12, wherein when the first and second waveguide parts and the electrically conducting sealing frame are mounted, the at least one waveguide filter protruding part protrudes between the first waveguide part and the second waveguide part, and enters into the cavity structure.

14. The transition arrangement according to claim 11, wherein the electrically conducting sealing frame comprises the at least one waveguide filter iris, and in that each of the first and second waveguide parts comprises the at least one waveguide filter protruding part.

15. The transition arrangement according to claim 11, wherein the electrically conducting sealing frame and the first and second waveguide parts are combined such that the wavequide filter comprises at least two cavity structures, the wavequide filter thus having at least two poles.

* * * * *

UNITED STATES PATENT AND TRADEMARK OFFICE

CERTIFICATE OF CORRECTION

PATENT NO. : 8,461,945 B2
APPLICATION NO. : 12/810053
DATED : June 11, 2013
INVENTOR(S) : Ligander et al.

It is certified that error appears in the above-identified patent and that said Letters Patent is hereby corrected as shown below:

In the Specification

Column 3, Line 17, delete “wavequide” and insert -- waveguide --, therefor.

Column 3, Line 62, delete “wavequide” and insert -- waveguide --, therefor.

Column 4, Line 45, delete “wavequide” and insert -- waveguide --, therefor.

Column 4, Line 47, delete “wavequide” and insert -- waveguide --, therefor.

Column 4, Line 63, delete “dosing” and insert -- closing --, therefor.

Column 7, Line 13, delete “wavequide” and insert -- waveguide --, therefor.

Column 7, Line 15, delete “wavequide” and insert -- waveguide --, therefor.

Column 8, Line 14, delete “wavequide” and insert -- waveguide --, therefor.

Column 8, Line 16, delete “wavequide” and insert -- waveguide --, therefor.

Column 8, Line 19, delete “Mon” and insert -- M on --, therefor.

In the Claims

Column 10, Line 58, in Claim 15, delete “wavequide” and insert -- waveguide --, therefor.

Column 10, Line 59, in Claim 15, delete “wavequide” and insert -- waveguide --, therefor.

Signed and Sealed this
Eighth Day of October, 2013

Teresa Stanek Rea

Teresa Stanek Rea
*Deputy Director of the United States Patent and Trademark Office*